US010784625B2

(12) United States Patent
Narama

(10) Patent No.: US 10,784,625 B2
(45) Date of Patent: Sep. 22, 2020

(54) CONNECTOR INCLUDING FITTING ASSURING COMPONENT

(71) Applicant: YAZAKI CORPORATION, Tokyo (JP)

(72) Inventor: Shunsuke Narama, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/581,672

(22) Filed: Sep. 24, 2019

(65) Prior Publication Data

US 2020/0136311 A1 Apr. 30, 2020

(30) Foreign Application Priority Data

Oct. 31, 2018 (JP) ..... 2018-205579

(51) Int. Cl.
*H01R 13/627* (2006.01)
*H01R 13/639* (2006.01)
*H01R 13/641* (2006.01)

(52) U.S. Cl.
CPC ..... *H01R 13/639* (2013.01); *H01R 13/6272* (2013.01); *H01R 13/641* (2013.01)

(58) Field of Classification Search
CPC ..... H01R 13/6272; H01R 13/6275; H01R 13/465; H01R 13/641
USPC ..... 439/352, 353, 354, 357, 358, 488, 489
See application file for complete search history.

(56) References Cited

U.S. PATENT DOCUMENTS 5,507,666 A * 4/1996 Yamanashi ..... H01R 13/641 439/489
5,681,178 A * 10/1997 Kunkle ..... H01R 13/641 439/352
5,807,130 A * 9/1998 Miller ..... H01R 13/641 439/352
5,879,180 A * 3/1999 Iwahori ..... H01R 13/641 439/352
6,354,860 B1 * 3/2002 Miller ..... H01R 13/6272 439/352
6,439,915 B2 * 8/2002 Kurimoto ..... H01R 13/6272 439/352
6,908,329 B2 * 6/2005 Kozono ..... H01R 13/641 439/352
7,326,074 B1 * 2/2008 Lim ..... H01R 13/629 439/352

(Continued)

FOREIGN PATENT DOCUMENTS

EP 3 171 459 A1 5/2017
JP 4664436 B2 4/2011
JP 2017-98222 A 6/2017

*Primary Examiner* — Thanh Tam T Le
(74) *Attorney, Agent, or Firm* — Kenealy Vaidya LLP

(57) ABSTRACT

A connector includes: a housing having a lock portion; and a fitting assuring component attached to the housing and detecting whether the housing and the counterpart housing being fitted with each other. The fitting assuring component has a hollow portion to house at least part of the lock portion to surround the at least part of the lock portion upon the fitting assuring component being located at the preset attachment position, and the fitting assuring component preventing the lock portion from switching to cancellation of the state of the housing and the counterpart housing being fitted with each other by interfering with an inside wall of the hollow portion.

5 Claims, 7 Drawing Sheets

(56) References Cited

U.S. PATENT DOCUMENTS

| | | | | |
|---|---|---|---|---|
| 7,399,195 | B2 * | 7/2008 | Kim | H01R 13/641<br>439/352 |
| 7,682,181 | B1 * | 3/2010 | Jones, Jr. | H01R 13/6272<br>439/352 |
| 7,909,638 | B2 * | 3/2011 | Seo | H01R 13/6272<br>439/489 |
| 8,628,344 | B2 * | 1/2014 | Cole | H01R 13/6272<br>439/352 |
| 9,325,114 | B2 * | 4/2016 | Miklinski | H01R 13/6273 |
| 10,153,586 | B1 * | 12/2018 | Schroll | H01R 13/639 |
| 10,468,805 | B2 * | 11/2019 | Evans | H01R 13/4368 |
| 10,587,076 | B2 * | 3/2020 | Evans | H01R 13/6273 |
| 2008/0139035 | A1 | 6/2008 | Kim et al. | |

* cited by examiner

CONNECTOR INCLUDING FITTING ASSURING COMPONENT

CROSS-REFERENCES TO RELATED APPLICATION(S)

This application is based on and claims priority from Japanese Patent Application No. 2018-205579 filed on Oct. 31, 2018, and the entire contents of which are incorporated herein by reference.

BACKGROUND

Field of the Invention

The present invention relates to a connector which is equipped with a housing and a fitting assuring component.

Description of Related Art

A technique of detecting whether a housing and a counterpart housing are in a properly fitted state (hereinafter referred to as a "complete fitting state") using a fitting assuring component (what is called CPA (connector position assurance) is known.

In general, fitting assuring components (CPAs) are used in housings having a lock arm capable of switching between keeping and cancellation of a complete fitting state (mentioned above). More specifically, the lock arm and the fitting assuring component are configured so that interference between them is avoided and the fitting assuring component is attached at a prescribed attachment position only in the complete fitting state. In other words, when the housing and the counterpart housing are not in the complete fitting state, the fitting assuring component interferes with the lock arm and is not attached at the prescribed attachment position. Thus, whether the housing and the counterpart housing are in the complete fitting state can be detected on the basis of whether the fitting assuring component can be attached at the prescribed attachment position.

As for details of the above terminal-attached electric wire, refer to JP 4,664,436 B and JP 2017-098222 A.

SUMMARY

Incidentally, from the viewpoint of improving the functions of a connector, to prevent occurrence of an event that the complete fitting state is cancelled unintentionally, it is conceivable to add, to the connector, a member for restricting an unintentional movement of a lock arm. However, the size of the connector may be increased if such a component is added carelessly. Thus, it is desirable to construct a connector so as to restrict movement of a lock arm in such a manner that size increase of the connector is minimized.

An object of the invention is to provide a connector capable of preventing occurrence of an event that fitting in or with a counterpart connector is canceled unintentionally, in such a manner that size increase of the connector is minimized.

Embodiments of the present invention provide the following items (1) to (3):

(1) A connector comprising:

a housing having a lock portion capable of switching between keeping and cancellation of a state of the housing and a counterpart housing being fitted with each other; and a fitting assuring component attached to the housing and detecting whether the housing and the counterpart housing being fitted with each other by being prevented from interfering with the lock portion and attached at a preset attachment position upon the housing and the counterpart housing being fitted with each other, the fitting assuring component having a hollow portion to house at least part of the lock portion to surround the at least part of the lock portion upon the fitting assuring component being located at the preset attachment position, and the fitting assuring component preventing the lock portion from switching to cancellation of the state of the housing and the counterpart housing being fitted with each other by interfering with an inside wall of the hollow portion.

(2) The connector according to the item (1), wherein the lock portion is a cantilever-shaped lock arm switching between keeping and cancellation of the state of the housing and the counterpart housing being fitted with each other by deforming in a preset bending direction; and the inside wall of the hollow portion having: one portion facing the lock portion on one side in the bending direction upon the fitting assuring component being in the preset attachment position; the other portion facing the lock portion on the other side in the bending direction; and an interference portion between the one portion and the other portion and preventing the lock portion from deforming to cancel the state of the housing and the counterpart housing being fitted with each other.

(3) The connector according to the item (1) or the item (2), wherein the housing having: a cantilever-shaped lock piece capable of deforming elastically in a direction to separate from the fitting assuring component; and a lock projection provided in the lock piece and preventing the fitting assuring component from separating from the housing by engaging with the fitting assuring component.

According to first aspect of the invention, relating to the item (1), when the fitting assuring component (what is called CPA) is located at the prescribed attachment position, at least part of the lock portion of the housing is housed in the hallow portion of the fitting assuring component and surrounded by the fitting assuring component. As a result, the lock portion is prevented from receiving an unintentional external force or the like from the outside. Furthermore, should an unintentional external force acts on the lock portion from the outside, the lock portion interferes with the inside wall of the hollow portion and is prevented from switching so as to cancel the fitting state. In this manner, unintentional cancellation of the fitting between the connector and the counterpart connector can be prevented.

Furthermore, the size of the connector can be made smaller than in a case that a member for protecting the above-described lock portion or a member that interferes with the lock portion is provided separately from the fitting assuring component because part (i.e., hollow portion) of the fitting assuring component serves as such a member.

As such, the connector having the above configuration can prevent unintentional cancellation of fitting in or with the counterpart connector while minimizing size increase of the connector.

According to second aspect of the invention, relating to the item (2), the interference portion for restricting movement of the lock portion by interfering with the lock portion (i.e., lock arm) is provided in the hollow portion at a middle position in the bending direction of the lock portion. The middle position is located between the one portion (e.g., a top wall of the hollow portion) and the other portion (e.g., a bottom wall of the hollow portion) of the inside wall in the bending direction. Thus, when, for example, an unintentional external force acts on the lock portion, the lock portion comes into contact with the interference portion of the inside wall before reaching the one portion or the other portion of the inside wall and is prevented from being bent further. Thus, the movable range of the lock portion is made narrower than in a case that the lock portion is prevented from being bent further by coming into contact with the one portion or the other portion. As such, the connector having the above configuration can prevent unintentional cancellation of fitting between the connector and the counterpart connector more reliably.

According to third aspect of the invention, relating to the item (3), the cantilever-shaped lock piece is provided with the lock projection to engage with the fitting assuring component. Thus, when the fitting assuring component comes into contact with the lock projection in attaching the fitting assuring component to the housing, the lock piece is bent elastically in such a direction as to go away from the fitting assuring component. As a result, attachment of the fitting assuring component to the housing is made easier than in a case that the lock projection is provided in a portion that is hard to bend. As such, the connector having the above configuration can increase the efficiency of work of attaching the fitting assuring component to the housing.

The invention can provide a connector capable of preventing occurrence of an event that fitting in or with a counterpart connector is canceled unintentionally, in such a manner that size increase of the connector is minimized.

The invention has been described above concisely. The details of the invention will become more apparent when the description of the embodiments described below are read through with reference to the accompanying drawings.

DETAILED DESCRIPTION

Embodiment

Figure 1:
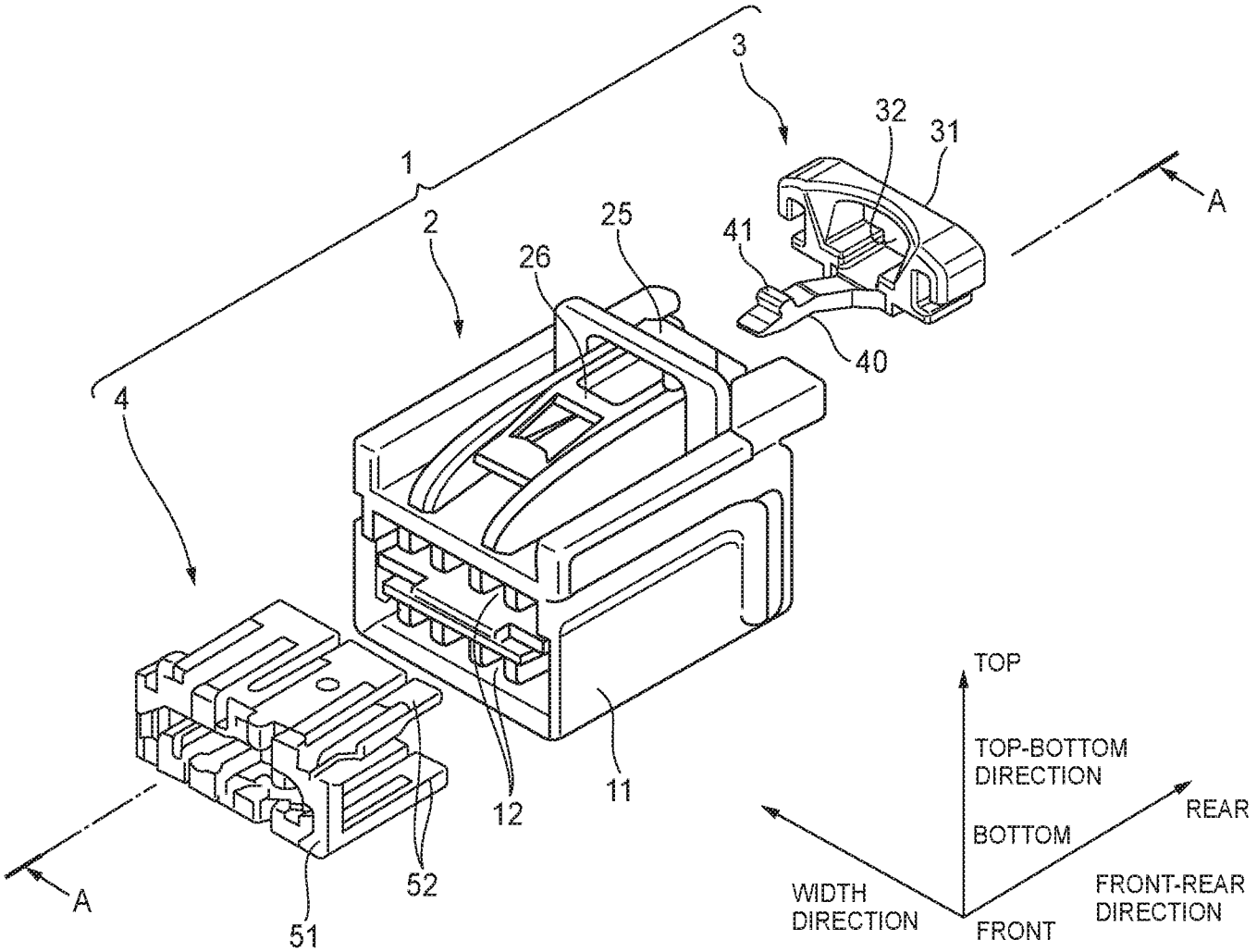
FIG. 1 is an exploded perspective view of a connector according to an embodiment of the present invention.

A connector 1 according to an embodiment of the present invention will be hereinafter described with reference to the drawings. In the following, for convenience of description, the "front-rear direction," "width direction," "top-bottom direction," "front," "rear," "top," and "bottom" are defined as shown in FIG. 1. The "front-rear direction" and the "width direction" are perpendicular to each other. The "front-rear direction" coincides with a direction in which the connector 1 and a counterpart connector 5 (see FIGS. 5 and 6) are fitted with each other. The front side is defined as the fore side (left side in FIG. 1) of a fitting direction in which the connector 1 is fitted in the counterpart connector 5, and the rear side is defined as the back side (right side in FIG. 1), opposite to the fore side, in the fitting direction.

As shown in FIG. 1, the connector 1 includes a housing 2, a fitting assuring component 3 (what is called CPA) which is attached to a top portion of the housing 2, and a front holder 4 which is attached to the housing 2 from the front side. The structures of the individual components of the connector 1 will be hereinafter described in order.

First, the housing 2 will be described with reference to FIG. 1, FIGS. 3A and 3B, and FIGS. 4A and 4B. The housing 2 which is made of a resin is equipped with a housing main body 11 which is approximately shaped like a rectangular prism. A top wall of the housing main body 11 projects rearward by a prescribed distance from its rear end surface. The thus-projected portion will be hereinafter referred to as a "projected portion." The housing main body 11 is fitted into a hood portion of a counterpart housing 61 of a counter connector 5 (see FIGS. 5 and 6), whereby the housing 2 and the counterpart housing 61 are fitted with each other.

As shown in FIGS. 3A and 3B and FIGS. 4A and 4B, plural terminal housing rooms 12 for housing respective female terminals (not shown) are formed inside the housing main body 11 so as to extend in the front-rear direction. In this example, the plural terminal housing rooms 12 are formed so as to be arranged in the horizontal direction in each of two (i.e., top and bottom) stages. In each terminal housing room 12, a small-diameter insertion hole 13 is formed through a front end portion and a rear end portion is opened. The female terminals are inserted into the respective terminal housing rooms 12 from the rear end side. When the housing 2 and the counterpart housing 61 are fitted with each other, male terminals 62 housed in the counterpart housing 61 are inserted into the respective insertion holes 13 (see FIGS. 5 and 6).

In fitting the housing 2 into the counterpart housing 61, a state that the housing 2 and the counterpart housing 61 are fitted with each other completely (i.e., the state shown in FIG. 5) past a halfway fitting state. In the following, for convenience of description, the former state will be referred to as a "complete fitting sate" and the latter state will be referred to as an "incomplete fitting state."

Figure 4A:
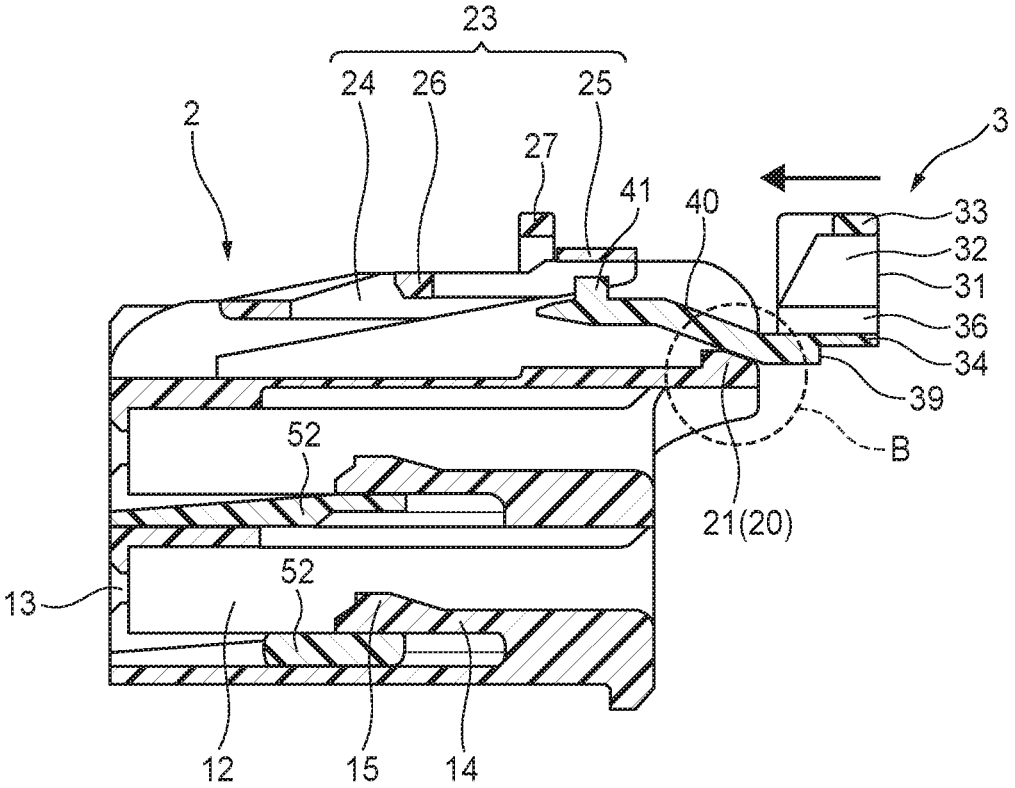
FIG. 4A is a sectional view taken along line A-A in FIG. 1 and showing a halfway stage of attachment of the fitting assuring component to the housing.

As shown in FIG. 4A, a cantilever-shaped lance 14 which can deform elastically in the top-bottom direction is provided in each terminal housing room 12 so as to enter the terminal housing room 12 from below and extend forward from a position on the rear end side of the terminal housing room 12. A lance projection 15 which projects upward in the terminal housing room 12 is formed at the tip of the lance 14 so as to be unitized with the other portion of the lance 14. The lance 14 exercises a function of preventing the associated female terminal from coming off rearward when a prescribed edge portion of the female terminal that is inserted into the terminal housing room 12 from the rear side is locked on the lance projection 15.

In a state that the female terminal is located at a regular insertion position (in other words, a state that the lance 14 is exercising its coming-off preventing function) in the terminal housing room 12, the lance projection 15 is put in the edge portion of the female terminal, whereby the lance 14 keeps a regular posture (see FIG. 4A) that it is not deformed elastically. On the other hand, in a state that the female terminal is located at a halfway insertion state (i.e., a state that the lance 14 is not exercising its coming-off preventing function), the lance 14 keeps a posture that it is deformed downward (i.e., away from the female terminal) elastically because the lance projection 15 cannot put in the edge portion of the female terminal.

Figure 3A:
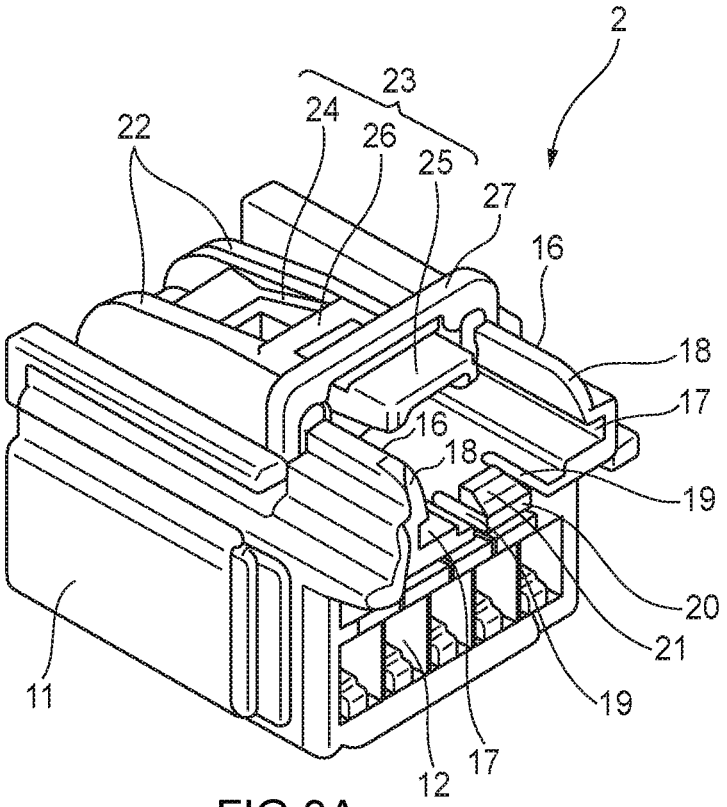
FIG. 3A is a rear perspective view of a housing shown in FIG. 1
Figure 3B:
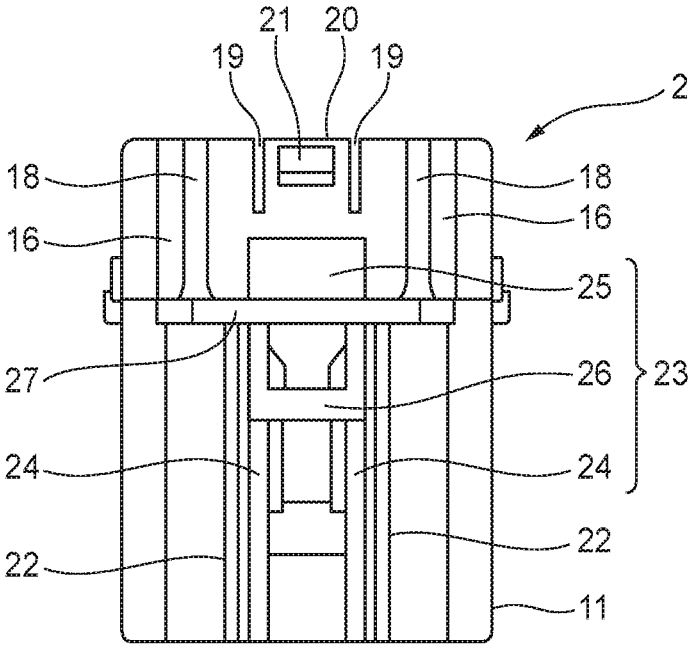
FIG. 3B is a top view of the housing.

As shown in FIGS. 3A and 3B, a rear portion of the top wall of the housing main body 11 is formed (unitized) with a pair of protective walls 16 which are erected upward, extend in the front-rear direction, and are opposed to each other in the width direction. The space formed between the pair of protective walls 16 functions as a space for attachment of the fitting assuring component 3. The fitting assuring component 3 is inserted into this space from the rear side and attached to the top wall of the housing main body 11.

The inner surface, in the width direction, of each protective wall 16 is formed with a guide groove 17 which is recessed outward in the width direction, is opened inside in the width direction, and extends in the front-rear direction. The top surface of each protective wall 16 is formed with a guide rib 18 which is erected upward and extend in the front-rear direction. The guide grooves 17 and the guide ribs 18 are used for guiding the fitting assuring component 3.

The projected portion of the top wall of the housing main body 11 is formed with, at the center in the width direction, a pair of slits 19 which extend in the front-rear direction and are spaced from each other in the width direction. A portion, located between the pair of slits 19, of the projected portion is a cantilever-shaped lock piece 20 which can deform elastically in the top-bottom direction. A lock projection 21 projects upward from the top surface of the lock piece 20. The lock projection 21 has a function of holding the fitting assuring component 3 at a tentative lock position (see FIG. 5).

As shown in FIGS. 3A and 3B, a front portion of the top wall of the housing main body 11 is formed (unitized) with a pair of protective walls 22 which are erected upward, extend in the front-rear direction, and are opposed to each other in the width direction. A lock portion 23 is provided in the space formed between the pair of protective walls 22. The lock portion 23 has a function of enabling switching between keeping and cancellation of the complete fitting state of the housing 2 and the counterpart housing 61 through engagement/disengagement between the lock portion 23 and a counterpart lock portion 63 (see FIGS. 5 and 6) of the counterpart housing 61.

As shown in FIGS. 3A and 3B and FIGS. 4A and 4B, the lock portion 23 has a pair of lock arms 24 which extend rearward like a cantilever from a front end portion, between the pair of protective walls 22, of the front portion of the top wall of the housing main body 11 so as to be spaced from each other in the width direction. The pair of lock arms 24 can deform elastically in the top-bottom direction.

The pair of lock arms 24 are unitized with a manipulation portion 25 which connects tip portions of the pair of lock arms 24 in the width direction and an engagement portion 26 which connects intermediate portions, in the front-rear direction, of the pair of lock arms 24 in the width direction. The complete fitting state of the housing 2 and the counterpart housing 61 is maintained as a result of engagement of the counterpart lock portion 63 (see FIGS. 5 and 6) with the engagement portion 26. When the manipulation portion 25 is pushed down in the complete fitting state, the engagement portion 26 is disengaged from the counterpart lock portion 63, whereby the housing 2 and the counterpart housing 61 can be separated from each other in the front-rear direction.

A link portion 27 which connects (is unitized with), in the width direction, so as to bridge, from above, the pair of lock arms 24 with a space formed in between, a pair of boundary portions between the pair of protective walls 22 and the pair of protective walls 16 which are formed on the front portion and the rear portion of the top wall of the housing main body 11, respectively. The link portion 27 has a function of suppressing excessive upward deformation of the pair of lock arms 24 by interfering with them when they are deformed upward elastically.

Figure 2A:
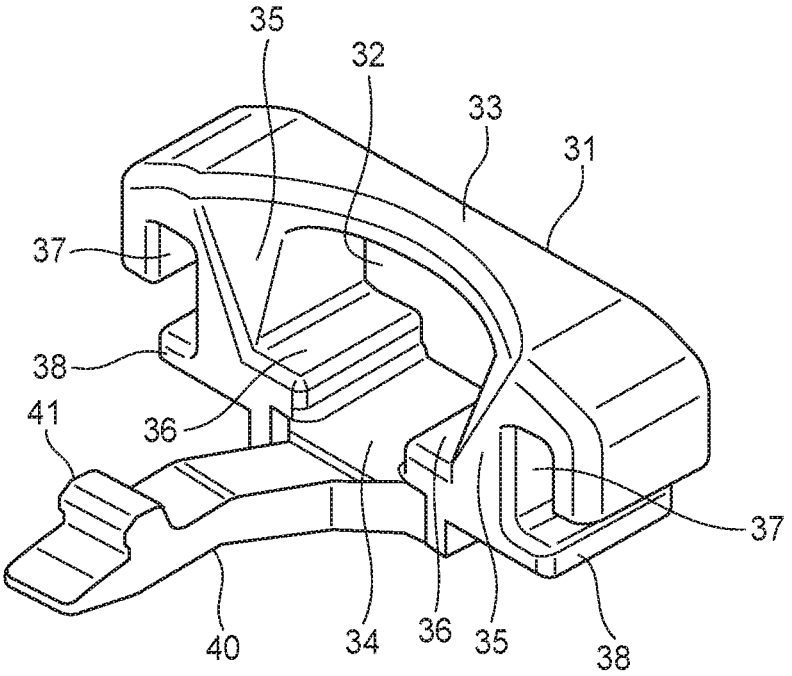
FIG. 2A is a perspective view of a fitting assuring component shown in FIG. 1
Figure 2B:
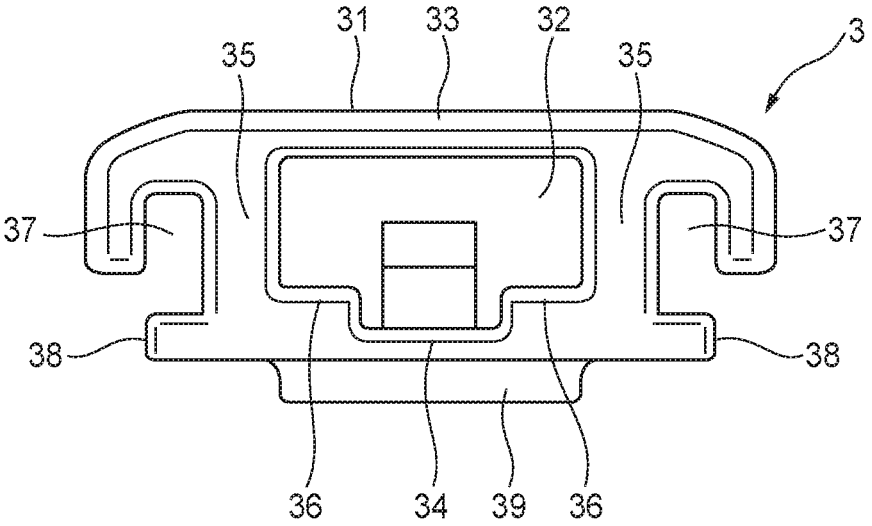
FIG. 2B is a rear view of the fitting assuring component.

Next, the fitting assuring component 3 will be described with reference to FIGS. 2A and 2B. The fitting assuring component 3 which is made of a resin has a base portion 31 which is approximately shaped like rectangular frame and has a hollow portion 32 inside. The base portion 31 is composed of a top wall 33 which extends in the width direction, a bottom wall 34 which extends in the width direction, and a pair of side walls 35 which extend in the top-bottom direction so as to connect two end portions, in the width direction, of the top wall 33 and two end portions, in the width direction, of the bottom wall 34, respectively. The hollow portion 32 is a space surrounded by the top wall 33, the bottom wall 34, and the pair of side walls 35. In this example, the hollow portion 32 is a through-hole that penetrates through the fitting assuring component 3 in the front-rear direction.

The bottom wall 34 is formed (unitized) with a pair of seat portions 36 which project upward from two respective end portions, in the width direction, of the top surface of the bottom wall 34. On the hollow portion 32, a rectangular space, surrounded by the top wall 33, the pair of seat portions 36, and the pair of side walls 35, is designed so as to have a width and a height that allow the manipulation portion 25 of the lock portion 23 to be inserted into the rectangular space.

Top portions of the two outer side surfaces, in the width direction, of the base portion 31 are formed with a pair of guide grooves 37, respectively, which are recessed upward, are opened at the bottom, and extend in the front-rear direction. Bottom portions of the two outer side surfaces, in the width direction, of the base portion 31 are formed with a pair of guide ribs 38, respectively, which project outward in the width direction and extend in the front-rear direction. These guide grooves 37 and guide ribs 38 are used for guiding the fitting assuring component 3 itself.

Figure 5:
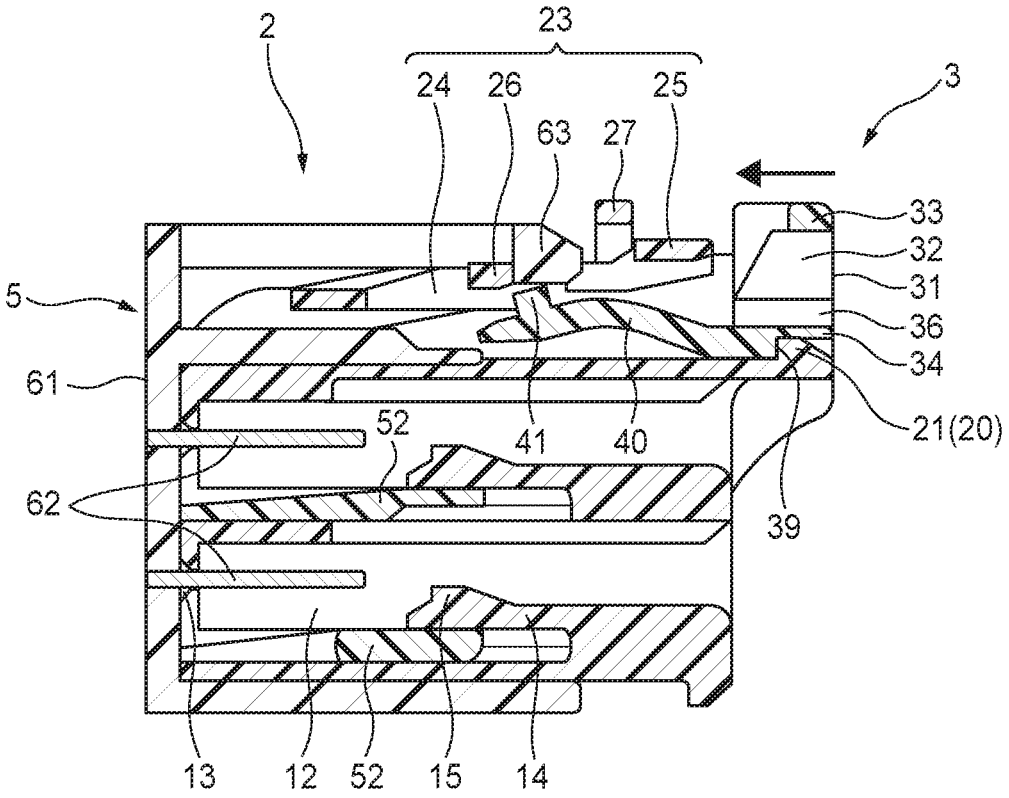
FIG. 5 is a sectional view corresponding to FIG. 4A and shows a stage that a counterpart housing and the housing have been rendered in a complete fitting state in a state that the fitting assuring component is located at a tentative lock state.

A lock projection 39 projects downward from the bottom surface of the bottom wall 34 of the base portion 31 (also refer to FIGS. 4A, 5, etc.). The fitting assuring component 3 is held at the tentative lock position when the lock projection 21 (see FIGS. 3A and 3B) of the housing 2 and the lock projection 39 of the fitting assuring component 3 engage with each other (see FIG. 5).

The bottom wall 34 of the base portion 31 is formed (unitized) with a detection arm 40 which extends forward from the front surface of the bottom wall 34. A tip portion (front end portion) of the detection arm 40 is formed with an engagement portion 41 (see FIGS. 4A and 5) which projects upward and is to be engaged with the engagement portion 26 of the lock portion 23.

Next, the front holder 4 will be described with reference to FIG. 1. The front holder 4 which is made of a resin is equipped with a base portion 51 which is approximately shaped like a rectangular frame and plural detection arms 52 which project rearward from (are unitized with) the base portion 51.

The front holder 4 is inserted into the housing main body 11 from the front side of the housing 2. When inserted in the housing main body 11, the front holder 4 is locked at a tentative lock position or a real lock position which is located in the rear of the tentative lock position by a lock mechanism (not shown). FIGS. 4A and 4B, FIG. 5, and FIG. 6 show a state that the front holder 4 is located at the real lock position.

When the female terminals are inserted into the terminal housing rooms 12 to regular insertion positions in a state that the front holder 4 is located at the tentative lock position, as described above the lances 14 keep their regular postures (i.e., postures shown in FIG. 4A). Thus, tip portions of the detection arms 52 of the front holder 4 can be inserted into gaps formed under the lances 14. As a result, in a state that the female terminals are located at the regular insertion positions, when the front holder 4 located at the tentative lock position is pushed rearward, as shown in FIGS. 4A and 5 the tip portions of the detection arms 52 enter the gaps formed under the lances 14 to thereby allow the front holder 4 to move to the real lock position.

On the other hand, in a state that the female terminals are located at the halfway insertion positions, as described above the lances 14 keep postures that they are deformed downward (i.e., away from the female terminals) elastically. Thus, the gaps formed under the lances 14 are narrowed to establish a state that the tip portions of the detection arms 52 interfere with tip portions of the lances 14 and cannot enter the gaps formed under the lances 14. As a result, the front holder 4 cannot move from the tentative lock position to the real lock position. In this manner, the front holder 4's being incapable of moving from the tentative lock position to the real lock position makes it possible to detect half insertion of the female terminals easily.

Next, an operation that is performed when the fitting assuring component 3 is attached to the housing 2 will be described with reference to FIGS. 4A and 4B, FIG. 5, and FIG. 6. To attach the fitting assuring component 3 to the housing 2, as shown in FIG. 4A the fitting assuring component 3 is brought closer to the space formed between the pair of protective walls 16 (see FIGS. 3A and 3B) of the housing 2 from the rear side. The guide ribs 18 (see FIGS. 3A and 3B) of the protective walls 16 are inserted into the respective guide grooves 37 (see FIGS. 2A and 2B) of the fitting assuring component 3 and the guide ribs 38 (see FIGS. 2A and 2B) of the fitting assuring component 3 are inserted into the guide grooves 17 (see FIG. 3A) of the protective walls 16, respectively. Then the fitting assuring component 3 is moved forward while being guided by the pair of protective walls 16.

The above forward movement of the fitting assuring component 3 is continued until the lock projection 39 of the fitting assuring component 3 goes over the lock projection 21 of the housing main body 11 and reaches the front side of the lock projection 21. The fitting assuring component 3 is held at the tentative lock position as a result of the lock projection 39's being located in front of the lock projection 21 as shown in FIG. 5.

Figure 4B:
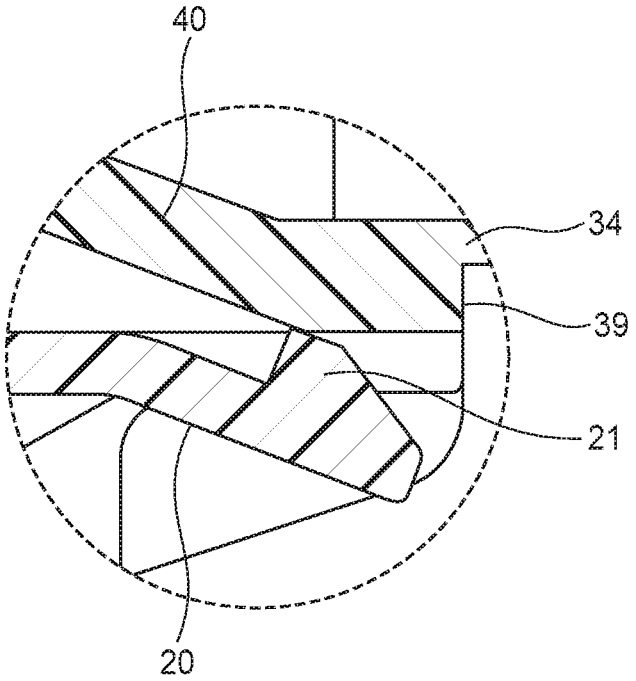
FIG. 4B is an enlarged view of part B of FIG. 4A.

When the lock projection 39 goes over the lock projection 21, the lock projection 39 pushes down the lock projection 21, whereby as shown in FIG. 4B the cantilever-shaped lock piece 20 which is formed with the lock projection 21 is bent downward elastically. In this manner, the lock projection 21 is moved downward easily. As a result, attachment of the fitting assuring component 3 to the housing 2 is easier than in a case that the lock projection 21 is not formed on the cantilever-shaped lock piece 20 (i.e., the lock projection 21 is not moved downward easily). Furthermore, crushing of portions, to come into contact with each other, of the lock projection 39 and the lock projection 21 can be prevented effectively when the former goes over the latter.

When the fitting assuring component 3 is located at the tentative lock position, the engagement portion 41 which is located at the tip portion of the detection arm 40 of the fitting assuring component 3 engages with the rear surface of the engagement portion 26 of the lock portion 23 of the housing 2. However, in the state shown in FIG. 5 shows a state that the engagement portion 41 of the detection arm 40 is pushed down by the counterpart lock portion 63 of the counterpart housing 61. Thus, in the state of FIG. 5, the engagement portion 41 is not engaged with the rear surface of the engagement portion 26 of the lock portion 23. The engagement portion 41 engages with the rear surface of the engagement portion 26 of the lock portion 23 in a state that the fitting assuring component 3 is located at the tentative lock position and the counterpart housing 61 and the housing 2 have not been in the complete fitting state yet. As a result, the fitting assuring component 3 cannot move from the tentative lock position to the real lock position (see FIG. 6) which is in front of the tentative lock position.

If as shown in FIG. 5 the counterpart housing 61 of the counterpart connector 5 is fitted with the housing 2 and the complete fitting state is thereby established in a state that the fitting assuring component 3 is located at the tentative lock position, the counterpart lock portion 63 engages with the rear surface of the engagement portion 26. As a result, the complete fitting state of the housing 2 and the counterpart housing 61 is maintained. Furthermore, at this time, the counterpart lock portion 63 pushes down the engagement portion 41, whereby the detection arm 40 is deformed downward elastically and the engagement portion 41 and the engagement portion 26 are disengaged from each other. That is, the fitting assuring component 3 can be moved from the tentative lock position to the real lock position.

Thus, in the complete fitting state (the state shown in FIG. 5), the fitting assuring component 3 is moved from the tentative lock position to the real lock position (see FIG. 6) while the detection arm 40 is kept deformed downward elastically by pushing the fitting assuring component 3 forward. As soon as the fitting assuring component 3 reaches the real lock position, the engagement portion 41 completes going over the engagement portion 26 and the detection arm 40 recovers elastically, whereby the engagement portion 41 comes to be located in front of the engagement portion 26. As a result, the fitting assuring component 3 is held at the real lock position.

Figure 6:
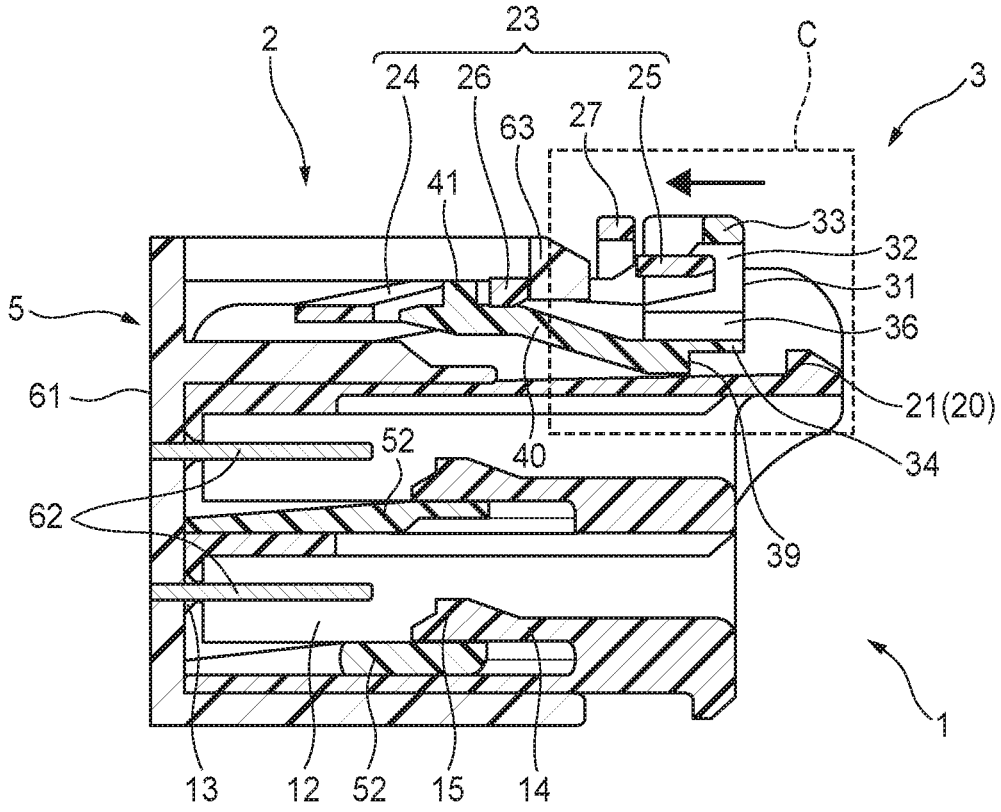
FIG. 6 is a sectional view corresponding to FIG. 4A and shows a stage that the fitting assuring component has moved from the tentative lock state to a real lock state in a state that the counterpart housing and the housing are in the complete fitting state.
Figure 7:
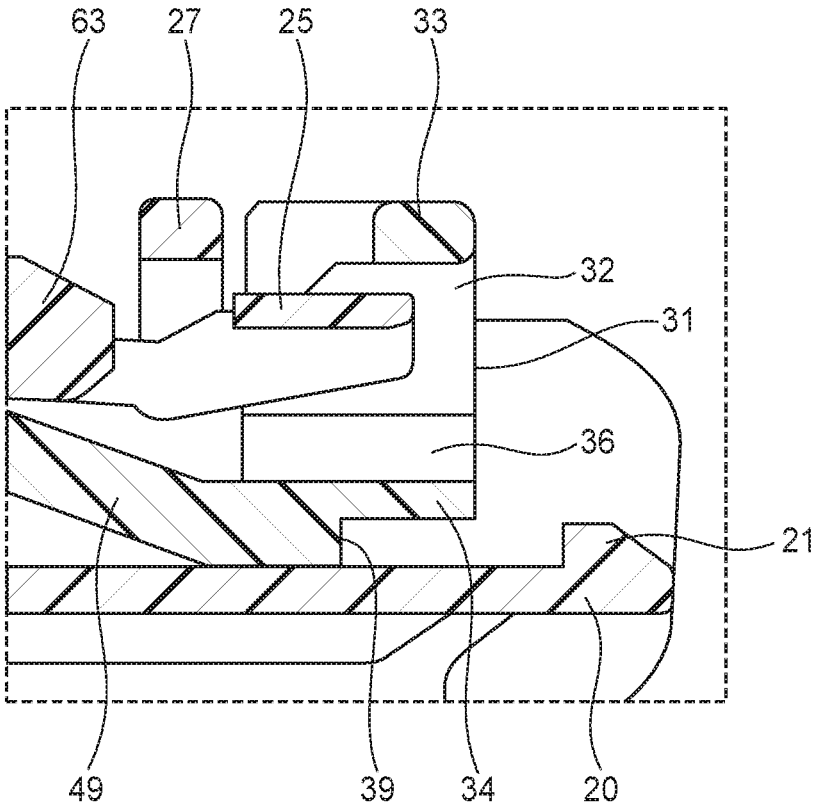
FIG. 7 is an enlarged view of part C of FIG. 6.

In a state that the fitting assuring component 3 is located at the real lock position, as shown in FIGS. 6 and 7 the manipulation portion 25 of the lock portion 23 is located in the hollow portion 32 of the fitting assuring component 3 and surrounded by the base portion 31 of the fitting assuring component 3. Thus, the manipulation portion 25 of the lock portion 23 is prevented from receiving external force or the like from the outside. Furthermore, should external force act on the manipulation portion 25 from the outside so as to push it down, the manipulation portion 25 interferes with the pair of seat portions 36 (see FIG. 2B) of the base portion 31. That is, the manipulation portion 25 comes into contact with the seat portions 36 before reaching the bottom wall 34 of the base portion 31; the downward bend (i.e., movable range) of the lock arms 24 is restricted. As a result, the engagement between the engagement portion 26 and the counterpart lock portion 63 is not canceled and hence the complete fitting state of the housing 2 and the counterpart housing 61 is maintained. That is, unintentional cancellation of the complete fitting state is prevented.

To cancel the complete fitting state shown in FIG. 6, first, the engagement portion 41 is disengaged from the engagement portion 26 by pushing the engagement portion 41 downward and, in this state, the fitting assuring component 3 is moved from the real lock position to the tentative lock position, that is, the manipulation portion 25 is moved to outside the hollow portion 32. What should be done in this state (i.e., the state of FIG. 5) is to push the manipulation portion 25 downward. As a result, the engagement between the engagement portion 26 and the counterpart lock portion 63 is canceled to establish a state that the housing 2 and the counterpart housing 61 can be detached from each other in the front-rear direction.

On the other hand, when the counterpart housing 61 and the housing 2 are in the incomplete fitting state, the counterpart lock portion 63 does not push the engagement portion 41 downward and hence the engagement between the engagement portion 41 and the engagement portion 26 is not canceled. Thus, the fitting assuring component 3 cannot move from the tentative lock position to the real lock position. The fact that the housing 2 and the counterpart housing 61 are in the incomplete fitting state can be detected easily through detection of the state that the fitting assuring component 3 cannot move from the tentative lock position to the real lock position.

As described above, in the connector 1 according to the embodiment of the invention, when the fitting assuring component 3 (what is called CPA) is located at the real lock position, the manipulation portion 25 of the lock portion 23 of the housing 2 is housed in the hallow portion 32 of the fitting assuring component 3 and surrounded by the frame-shaped base portion 31 of the fitting assuring component 3. As a result, the lock portion 23 is prevented from receiving external force or the like from the outside. Furthermore, should external force acts on the lock portion 23 from the outside, the manipulation portion 25 of the lock portion 23 interferes with the seat portions 36 of the base portion 31. In this manner, unintentional cancellation of the complete fitting state can be prevented.

Furthermore, since the manipulation portion 25 of the lock portion 23 is housed in the hollow portion 32 of the fitting assuring component 3, the size of the entire connector 1 including the housing 2 and the fitting assuring component 3 can be made smaller than in a case that a member for protecting the lock portion 23 or a member that interferes with the lock portion 23 is provided separately from the fitting assuring component 3.

As such, the connector 1 having the above configuration can prevent unintentional cancellation of fitting in the counterpart connector 5 while minimizing size increase of the connector 1.

The seat portions 36 for restricting movement of the lock portion 23 by interfering with (the manipulation portion 25 of) the lock portion 23 is provided in the hollow portion 32 at a middle position (between the top wall 33 and the bottom wall 34) in the bending direction of the lock portion 23. Thus, when, for example, an unintentional external force acts on the lock portion 23, the lock portion 23 comes into contact with the seat portions 36 before reaching the bottom wall 34 and is prevented from being bent further. Thus, the movable range of the lock portion 23 is made narrower than in a case that there are no interference portions such as the seat portions 36 and the lock portion 23 reaches the bottom wall 34. As such, the connector 1 having the above configuration can prevent unintentional cancellation of fitting in the counterpart connector 5 more reliably.

Since the bottom wall 34 is offset downward from the seat portions 36, a die for forming the hollow portion 32 (more specifically, a block of the die) can be made larger than in a case that the seat portions 36 are not provided and instead only the bottom wall 34 occupies the regions of the missing seat portions 36. As such, the connector 1 having the above configuration is easier in handling of a die for manufacture of the connector 1 and higher in strength.

Furthermore, the cantilever-shaped lock piece 20 is provided with the lock projection 21 which is to engage with the lock projection 39 of the fitting assuring component 3. Thus, when the lock projection 39 of the fitting assuring component 3 comes into contact with the lock projection 21 in attaching the fitting assuring component 3 to the housing 2, the lock piece 20 is bent elastically in such a direction as to go away from the fitting assuring component 3. As a result, attachment of the fitting assuring component 3 to the housing 2 is made easier than in a case that the cantilever-shaped lock piece 20 is not provided with the lock projection 21. In is therefore understood that in the connector 1 having the above configuration the fitting assuring component 3 can restrict movement of the lock portion 23 easily and reliably and unintended cancellation of fitting in the counterpart connector 5 can be prevented more reliably.

Other Embodiments

The invention is not limited to the above embodiment and various modifications, improvements, etc. can be made as appropriate within the scope of the invention. The materials, shapes, sets of dimensions, numbers, locations, etc. of the respective constituent elements of the above embodiment are not limited to those disclosed but can be determined in desired manners as long as the invention can be implemented.

In the above embodiment, the pair of seat portions 36 which project upward from the two respective end portions of the top surface of the bottom wall 34 are provided as an interference portions" which is a term employed in the claims. In contrast, a pair of projection portions which project inward in the width direction from middle positions, in the top-bottom direction, of the inner surfaces, in the width direction, of the pair of side walls 35 may be provided as the "interference portion." Also with this measure, when an unintentional external force, for example, acts on the lock portion 23, the lock portion 23 comes into contact with the pair of projection portions before reaching the bottom wall 34, whereby the lock portion 23 can be prevented from bending further.

Furthermore, in the embodiment, the through-hole which penetrates through the fitting assuring component 3 in the front-rear direction is provided as a "hollow portion" which is a term employed in the claims. However, the "hollow portion" need not always penetrate through the fitting assuring component 3 as long as it houses end portions of the lock arms 24 and can thereby prevent unintentional deformation of the lock arms 24. For example, the fitting assuring component 3 may be formed with, as the "hollow portion," a housing hole (e.g., recess or groove) which is recessed so as to be open on the front side where it is opposed to the lock arms 24 and to be closed on the rear side.

Features of the above-described connector 1 according to the embodiment of the invention will be summarized below concisely in the forms of items [1] to [3];

[1] A connector (1) comprising:

a housing (2) having a lock portion (23) capable of switching between keeping and cancellation of a state of the housing (2) and a counterpart housing (61) being fitted with each other; and a fitting assuring component (3) attached to the housing (2) and detecting whether the housing (2) and the counterpart housing (61) being fitted with each other by being prevented from interfering with the lock portion (23) and attached at a preset attachment position upon the housing (2) and the counterpart housing (61) being fitted with each other, the fitting assuring component (3) having a hollow portion (32) to house at least part of the lock portion (23) to surround the at least part of the lock portion (23) upon the fitting assuring component (3) being located at the preset attachment position, and the fitting assuring component (3) preventing the lock portion (23) from switching to cancellation of the state of the housing (2) and the counterpart housing (61) being fitted with each other by interfering with an inside wall (36) of the hollow portion (32).

[2] The connector (1) according to the item [1], wherein the lock portion (23) is a cantilever-shaped lock arm (24) switching between keeping and cancellation of the state of the housing (2) and the counterpart housing (61) being fitted with each other by deforming in a preset bending direction; and the inside wall (36) of the hollow portion (32) having: one portion (33) facing the lock portion (23) on one side in the bending direction upon the fitting assuring component (3) being in the preset attachment position; the other portion (34) facing the lock portion (23) on the other side in the bending direction; and an interference portion (36) between the one portion (33) and the other portion (34) and preventing the lock portion (23) from deforming to cancel the state of the housing (2) and the counterpart housing (61) being fitted with each other.

[3] The connector (1) according to the item [1] or the item [2], wherein the housing (2) having: a cantilever-shaped lock piece (20) capable of deforming elastically in a direction to separate from the fitting assuring component (3); and a lock projection (21) provided in the lock piece (20) and preventing the fitting assuring component (3) from separating from the housing (2) by engaging with the fitting assuring component (3).

REFERENCE SIGNS LIST

1: Connector
2: Housing
3: Fitting assuring component
20: Lock piece
21: Lock projection
23: Lock portion
24: Lock arm
25 (At least part of) manipulation portion
32: Hollow portion
33: Top wall (one portion)
34: Bottom wall (the other portion)
36: Seat portion (inside wall, interference portion)
61: Counterpart housing

The invention claimed is:

1. A connector comprising:

a housing having a lock portion capable of switching between keeping and cancellation of a state of the housing and a counterpart housing being fitted with each other; and a fitting assuring component attached to the housing and detecting whether the housing and the counterpart housing being fitted with each other by being prevented from interfering with the lock portion and attached at a preset attachment position upon the housing and the counterpart housing being fitted with each other, the fitting assuring component having a hollow portion to house at least part of the lock portion to surround the at least part of the lock portion upon the fitting assuring component being located at the preset attachment position, and the fitting assuring component preventing the lock portion from switching to cancellation of the state of the housing and the counterpart housing being fitted with each other by interfering with an inside wall of the hollow portion, and the housing further having: a cantilever-shaped lock piece spaced away from the lock portion and capable of deforming elastically in a direction to separate from the fitting assuring component; and a lock projection provided in the lock piece and preventing the fitting assuring component from separating from the housing by engaging with the fitting assuring component.

2. The connector according to claim 1, wherein the lock portion is a cantilever-shaped lock arm switching between keeping and cancellation of the state of the housing and the counterpart housing being fitted with each other by deforming in a preset bending direction; and the inside wall of the hollow portion having: one portion facing the lock portion on one side in the bending direction upon the fitting assuring component being in the preset attachment position; an other portion facing the lock portion on an other side in the bending direction; and an interference portion between the one portion and the other portion and preventing the lock portion from deforming to cancel the state of the housing and the counterpart housing being fitted with each other.

3. The connector according to claim 2, wherein the inside wall has a top wall, a bottom wall, a first side wall extending from the top wall to the bottom wall, and a second side wall extending from the top wall to the bottom wall, the one portion of the hollow space is located on the top wall and the other portion of the hollow portion is located on the bottom wall, and the interference portion extends from the bottom wall toward the top wall.

4. The connector according to claim 3, wherein the interference portion abuts the first side wall and includes a surface that is spaced away from the bottom wall.

5. The connector according to claim 3, wherein the interference portion abuts the first side wall, the interference portion includes a surface that is spaced away from the bottom wall, and the interference portion extends from the bottom wall and toward the top wall.

* * * * *